US005114110A

United States Patent [19]

Vohora

[11] Patent Number: 5,114,110

[45] Date of Patent: May 19, 1992

[54] SUPPORT APPARATUS

[76] Inventor: Ashni K. Vohora, 30, Inglewood Avenue, Heatherside, Camberley, Surrey GU15 1RL, United Kingdom

[21] Appl. No.: 424,656

[22] Filed: Oct. 19, 1989

Related U.S. Application Data

[63] Continuation-in-part of Ser. No. 933,065, Nov. 20, 1986, abandoned.

[51] Int. Cl.[5] ..... A47B 19/00

[52] U.S. Cl. ..... 248/444; 248/160; 248/451

[58] Field of Search ..... 248/441.1, 451, 454, 248/444, 160, 463

[56] References Cited

U.S. PATENT DOCUMENTS

| | | | |
|---|---|---|---|
| 1,649,217 | 11/1927 | Eshleman | 248/444 |
| 1,938,528 | 12/1933 | Marseglia | 248/454 X |
| 2,471,003 | 5/1949 | Monahan | 248/444 X |
| 2,481,107 | 9/1949 | Gore | 248/444 |
| 2,486,174 | 10/1949 | Kissling | 248/441.1 X |
| 2,535,803 | 12/1950 | Maack | 248/160 |
| 3,351,312 | 11/1967 | Ballas | 248/451 X |
| 4,512,603 | 4/1985 | Williams | 248/451 X |

FOREIGN PATENT DOCUMENTS

| | | | |
|---|---|---|---|
| 543073 | 5/1956 | Italy | 248/454 |
| 10209 | of 1913 | United Kingdom | 248/451 |
| 158167 | 2/1921 | United Kingdom | 248/463 |
| 524002 | 7/1940 | United Kingdom | 248/454 |

*Primary Examiner*—David L. Talbott
*Attorney, Agent, or Firm*—Weintraub, DuRoss & Brady

[57] ABSTRACT

The support apparatus is for the retention thereon of a book, and comprises a carriage member, a flexible support member, and an elastic cord to retain the pages of the open book while the book is being read. The carriage member preferably has an essentially flat surface upon which the book is positionable. The flexible support member is readily deformable into a multiplicity of serpentine configurations. The flexible support member is capable of supporting the carriage member and the book in a first configuration without deformation. The flexible support member remains in the first configuration until the flexible support member is deformed and manipulated into a second configuration. The flexible support member is affixed to the carriage member. An elastic cord pulled taut through two apertures disposed through the flat surface of the carriage member is used to retain the pages of the book when the book is in the open position.

6 Claims, 2 Drawing Sheets

SUPPORT APPARATUS

CROSS-REFERENCE TO COPENDING APPLICATION

This is a continuation-in-part of U.S. patent application design Ser. No. 06/933,065 filed on Nov. 20, 1986, entitled "Adjustable Support for a Book or the Like" by Ashni K. Vohara, now abandoned.

BACKGROUND OF THE INVENTION

1. Field of the Invention

This invention relates to a support apparatus having a structure that is readily adjustable in configuration, and more particularly for supporting, for example, a book in a position in which a user of the apparatus will find reading to be comfortable, and enabling the turning of pages to be accomplished both quickly and easily.

2. Background Art

Although various support structures are known in the art, none of them are adaptable for the innumerable applications as is the present invention.

SUMMARY OF THE INVENTION

The support apparatus of the present invention is portable and flexible with respect to various configurations, and is particularly suitable for supporting a book, plates and other dinnerware for serving a meal, a small radio receiver or a television, a small alarm clock, or a calculator. The user of the support apparatus may use the apparatus while stationary or while moving about. Not only is the support apparatus adaptable for a number of applications, the support apparatus may even by worn (about the neck or waist of the user), adapted to cooperate with a fixed support (such as a bar), or otherwise proximate to a user.

The support apparatus of the present invention may be particularly useful with bedridden individuals who are permanently or temporarily incapacitated in hospitals, nursing homes, and homes for the aged, and in other circumstances where a person must make reference to books or the like while using one's hands to perform other nonrelated operations.

The support apparatus comprises a carriage member for support an objection, a flexible support member, and when the object is a book means for retaining the pages of the open book while the book is being read.

The carriage member preferably has an essentially flat surface upon which the object is positionable. A flange is preferably disposed along the lower edge of the carriage member, the object being positionable against the flange when the carriage member is in an inclined orientation.

The flexible support member is readily deformable into a multitude of serpentine configurations. The flexible support member is capable of supporting the carriage member and the object in a first configuration without deformation. The flexible support member remains in the first configuration until the flexible support member is deformed and manipulated into a second configuration. The flexible support member is affixed to the carriage member.

The means for retaining the pages of the book when the book is in the open position preferably comprise two apertures disposed through the flat surface of the carriage member and an elastic cord extending through the two apertures, the elastic cord being pulled taut. The pages of the book are retainable by the elastic cord when the book is in the open position enabling the pages of the book to be read and subsequently turned.

For a more complete understanding of the support apparatus of the present invention, reference is made to the following detailed description and accompanying drawings in which the presently preferred embodiments of the invention is illustrated by way of example. As the invention may be embodied in several forms without departing from the spirit or essential characteristics thereof, it is expressly understood that the drawings are for purposes of illustration and description only, and are not intended as a definition of the limits of the invention. Throughout the following description and drawings, identical reference numbers refer to the same component throughout the several views.

DETAILED DESCRIPTION OF THE PREFERRED EMBODIMENTS

Figure 1:
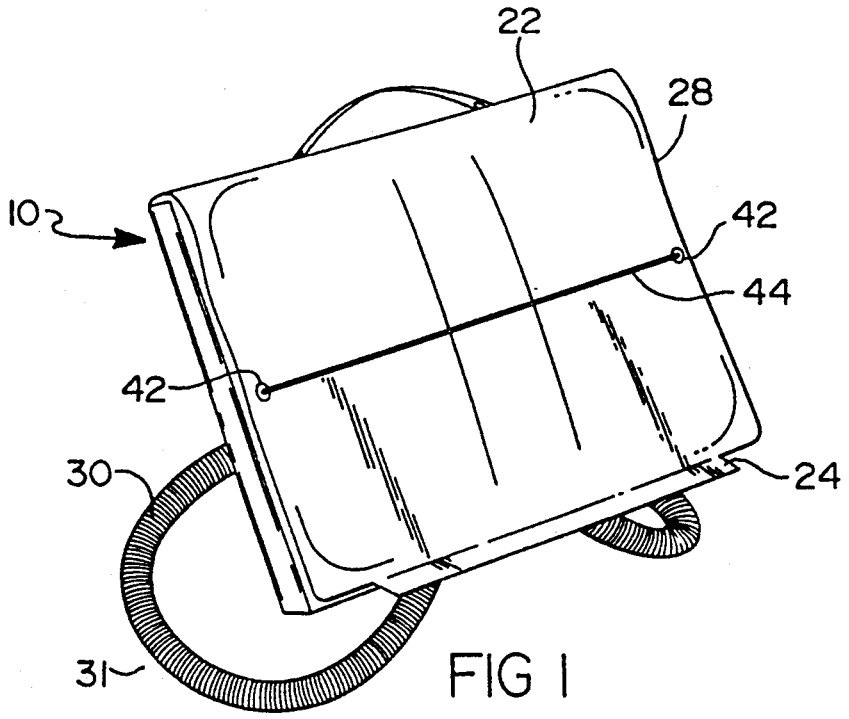
FIG. 1 is a front perspective view of the preferred embodiment of the adjustment support of the present invention, the adjustment support being depicted in a first configuration.
Figure 2:
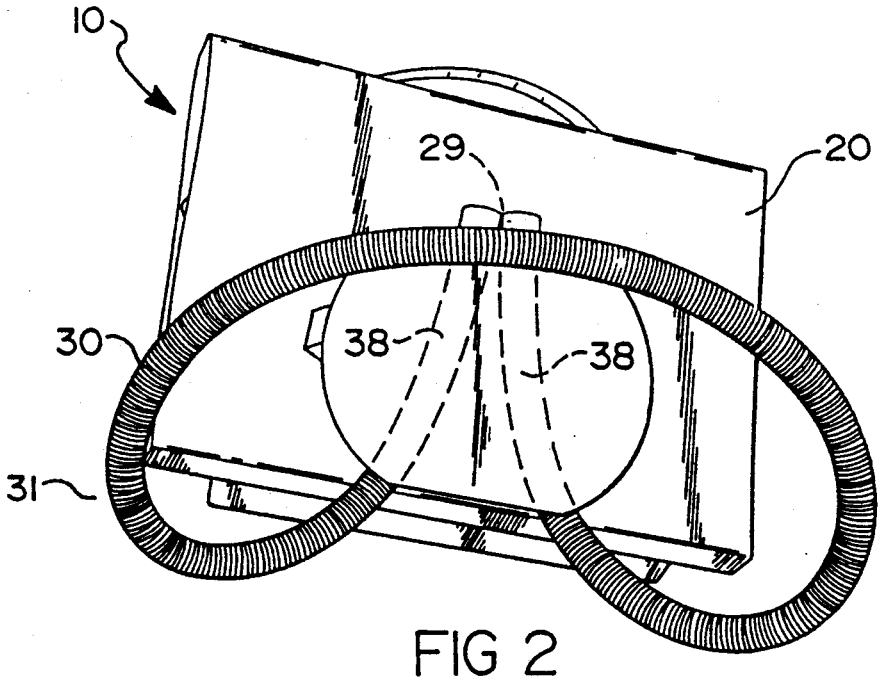
FIG. 2 is a rear perspective view of the adjustment support of FIG. 1 in the first configuration.

Referring now the drawings, FIGS. 1 and 2 depict two different views the preferred embodiment of the support apparatus 10 of the present invention. The support apparatus 10 preferably comprises a carriage member 20 for retaining an object thereon, a flexible support member 30, and if the object is a book means 40 for retaining the pages of the open book (not shown) while the book is being read.

The support apparatus 10 comprises a length of tubing constructed and arranged to tend automatically to remain in any configuration into which it is manually shaped the tubing being connected to a member which is arranged to support an object for employment by a user of the support apparatus 10 in a desired position relative to the user.

The carriage member 20 preferably has an essentially flat surface 22 upon which the object is positionable. A flange 24 is preferably disposed along the lower edge 25 of the carriage member 20, the object being positionable against the flange 24 when the carriage member 20 is in an inclined orientation.

The carriage member 20 is of basically oblong configuration but has large rounded corners. The carriage member 20 preferably measures about 360 millimeters in width and about 260 millimeters in height, with a thickness of about 50 millimeters. The carriage member 20 is preferably formed from a readily moldable synthetic plastic material such as polyethylene, polystyrene, or polyvinyl chloride, and is hollow, having only relatively thin front and rear walls and an interconnecting side wall that extends therebetween.

Figure 3:
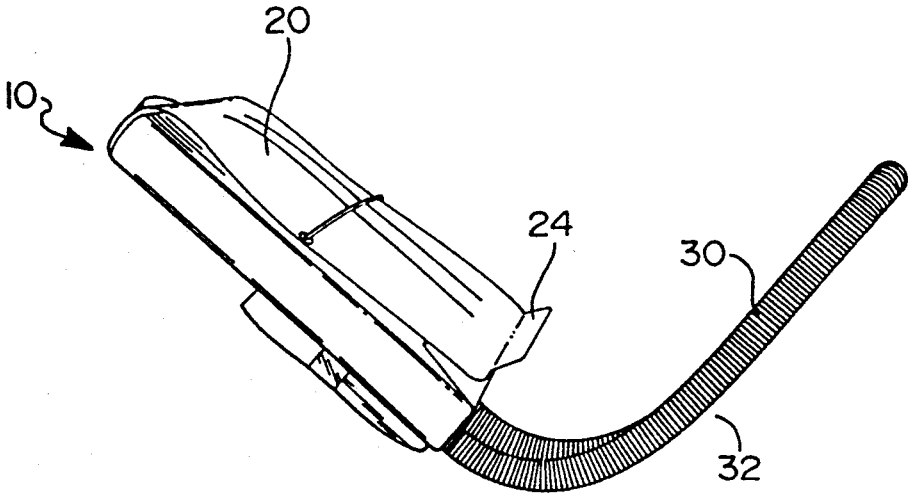
FIG. 3 is a side perspective view of the adjustment support of FIG. 1, the adjustment support being depicted in a second configuration.

The flexible support member 30 is readily deformed into a multitude of serpentine configurations. The flexible support member 30 is capable of supporting the carriage member 20 and the object disposed thereon in a first configuration without deformation. The flexible support member 30 remains in the first configuration 31 until the flexible support member 30 is deformed and manipulated into a second configuration 32 (see FIG. 3). The flexible support member 30 is affixed to the carriage member 20.

The flexible support member 30 is preferably made of a length of commercially available product which is known as "stayput®" tubing (the trademark being owned by the Allied Metal Hose Company of Long Island City, N.W.). The flexible support member 30 is commercially available from the Universal Metal Hose Company of Chicago, Ill. The product is a semi-flexible coolant hose made of soft-spring steel and is available in diameters of three-quarters of an inch or more.

Although the precise length of the flexible support member 30 is not critical, a support apparatus 10 in accordance with the invention may advantageously incorporate a flexible support member 30 having a length of at least 1.5 meters and a diameter of 20 to 25 millimeters. The flexible support member 30 is readily manually deformable into an almost infinite number of curved and partially-curved/partially straightened configurations, and will tend automatically to remain in any shape until manual forces are again applied to the flexible support member 30 to change that configuration.

The means 40 for retaining the pages of the open book preferably comprise two apertures 42 disposed through the flat surface 22 of the carriage member 20 and an elastic cord 44 extending through the two apertures 42, the elastic cord 44 being pulled taut. The distance between the two apertures 42 is greater than the width of the book in the open position. The pages of the book are retainable by the elastic cord 44 when the book is in the open position enabling the pages of the book to be read and subsequently turned.

Four apertures are formed in the front wall of the carriage member 20 in the two parallel pairs that extend generally perpendicular to the width of the carriage member 20. An elastic cord 44 extends perpendicularly to the apertures 42 across the exposed surface of the front wall of the carriage member 20.

Alternatively, a first elastic cord may be disposed on the right side of the carriage member, and a second cord may be disposed on the left side of the carriage member, each of the cords being oriented perpendicularly relative to the flange, the first elastic cord retaining the pages of the book disposed on the right side, and the second elastic cord retaining pages of the book disposed on the left side (not shown).

Recesses 38 are preferably formed within the rear surface of the carriage member 20 that receives the end portions 29 of the flexible tubing member 30. The recesses 38 enable the end portions 29 of the flexible tubing member 30 to be affixed to the carriage member 20.

The remaining portions of the flexible tubing member 30 that are not confined by the carriage member 20 may be bent into any required supporting configuration, such as, for example, a semi-circular base, spirals to extend around rails, or configurations which will embrace the neck or waist of the user. The support apparatus 10 is portable and is deformable into an innumerable number of configurations which the support apparatus 10 can be brought to for co-operation that may have many dispositions and orientations.

A book may be supported by the carriage member 20 by first positioning the book onto the front surface 22, and then opening the book and securing the pages by the elastic cord 44. The spine of the book will then bear rearwardly against a central region of the front wall of the carriage member 20 between the innermost two slots. The elastic cord 44 retains the pages of the book in this position and allows the pages to be turned one at a time in a conventional manner, positively maintaining the pages open in a readable position while the pages are being turned.

Figure 4:
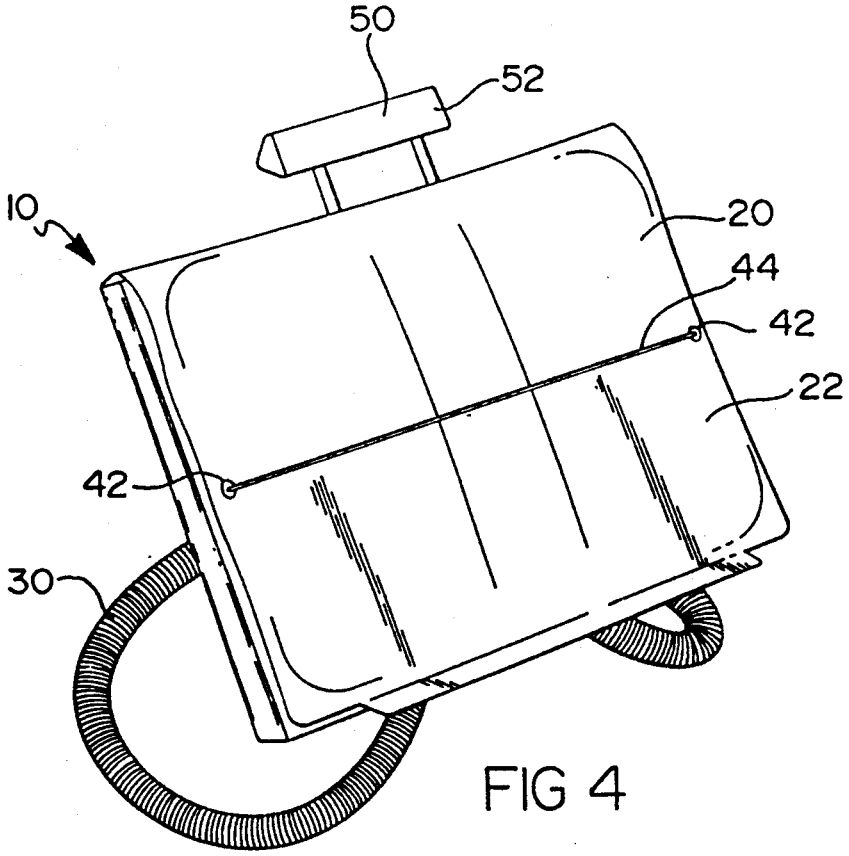
FIG. 4 is a front perspective view of another embodiment of the present invention, similar to the embodiment depicted in FIG. 1, but with an illuminator to light up the flat surface of the carriage member.

FIG. 4 depicts an alternate embodiment of the support apparatus 10, having an illuminating means 50 disposed onto the carriage member 20. The end of the flexible tubing member 30 to which the lamp 52 is attached may then be bent and shaped in an appropriate manner to direct the illumination as desired. If the support apparatus 10 is to be fully portable, the power supply for the lamp 52 will be rechargeable batteries. There are circumstances, however, where main electricity may be of a kind that is provided with suitable electrical wiring to enable it to be operated on main electric power.

While the support apparatus 10 of the present invention has been described in conjunction with a specific embodiments it is evident that many alternatives, modifications, and variations will be apparent to those skilled in the art in light of the disclosure herein. It is intended that the metes and bounds of the invention be determined by the appended claims rather than by the language of the above specifications, and that all such alternatives, modifications, and variations which form a functional or conjointly cooperative equivalent are intended to be inclined within the spirit and scope of these claims.

I claim:

1. A support apparatus for retaining a book thereon, comprising:

(a) a carriage member having:

(1) an essentially flat surface upon which a book may be disposed, the flat surface having a forward side and a reverse side, the flat surface further having at least a pair of recesses formed in the reverse side thereof and the flat surface being positionable in an inclined orientation;

(2) a flange disposed along the lower edge of the flat surface of the carriage member;

(3) at least a pair of spaced apart apertures formed in the flat surface; and (4) an elastic cord extending through the apertures, the cord traversing and retaining the book on a flat forward side of the flat surface;

(b) a flexible support member deformable to enable securement about various regions of the body of a user, the flexible support member having opposed end portions, the end portions being received into and removably seating in the recesses of the carriage member, the flexible support member being affixed to the carriage member, the flexible support member being readily deformable into a multiplicity of serpentine configurations, the flexible support member being capable of supporting the carriage member and the book placed thereon in a first configuration without deformation, the flexible support member remaining in the first configuration until manual forces are applied to deform the flexible support member into a second configuration.

2. The support apparatus of claim 1, wherein the distance between the two apertures is greater than the width of the book in the open position.

3. The support apparatus of claim 1, wherein the flange is essentially parallel to the elastic cord.

4. The support apparatus of claim 1, further comprising illuminating means disposed proximate to the carriage member, the illuminating means providing illumination for the surface of the carriage member.

5. The support apparatus of claim 1, wherein the carriage member further comprises a handle, the handle disposed along the upper edge of the carriage member.

6. In a support apparatus for retaining a book thereon, the book having a closed position and an open position, the support apparatus being of the type comprising:

(a) a carriage member, the carriage member having a first forward surface upon which the book is positionable;

(b) a flexible support member having first and second ends being affixed to the carriage member;

(c) means for retaining the pages of the book comprising:

the flat surface of the carriage member having two apertures formed therein; and an elastic cord extending through the two apertures and transversing the book in the horizontal plane, the pages being retainable by the elastic cord when the book is in the open position;

(d) a flange disposed along an edge of the carriage member, essentially parallel to the elastic cord, the book being positionable against the flange when the carriage member is in an inclined position; and (e) an means for illuminating disposed proximate to the carriage member, the means for illuminating providing illumination for the surface of the carriage member;

the rear surface having a pair of spaced apart recesses formed therein, the ends of the flexible member being removably seatable in the recesses, the improvement which comprises:

the flexible support member being deformable to enable securement about various regions of the body of a user, the support member being readily deformable into a multiplicity of serpentine configurations, the flexible support member being capable of supporting the carriage member and the book placed therein in a first configuration, the flexible support member remaining in a first configuration until manual forces are applied to deform the flexible support member into a second configuration.

* * * * *